United States Patent [19]

Campbell

[11] 4,438,022

[45] Mar. 20, 1984

[54] LUBRICATING OIL COMPOSITIONS CONTAINING POLYETHER POLYAMINE ETHANES

[75] Inventor: Curtis B. Campbell, Rodeo, Calif.

[73] Assignee: Chevron Research Company, San Francisco, Calif.

[21] Appl. No.: 403,606

[22] Filed: Jul. 30, 1982

[51] Int. Cl.[3] ..... C10M 1/32

[52] U.S. Cl. ..... 252/51.5 R; 252/51.5 A

[58] Field of Search ..... 252/51.5 A, 51.5 R

[56] References Cited

U.S. PATENT DOCUMENTS 4,049,716 9/1977 Collet ..... 252/51.5 A 4,198,306 4/1980 Lewis ..... 252/51.5 R 4,233,168 11/1980 Lewis et al. ..... 252/51.5 R

*Primary Examiner*—Jacqueline V. Howard

*Attorney, Agent, or Firm*—D. A. Newell; J. M. Whitney; Q. T. Dickinson

[57] ABSTRACT

Additives for lubricating oils for internal combustion engines which contribute dispersancy and detergency to the lubricating oils are disclosed. The additives are hydrocarbylpoly(oxyalkylene) polyamine ethanes comprising a hydrocarbyl-terminated poly(oxyalkylene) chain of 2–5 carbon oxyalkylene units bonded to an ethane or substituted ethane chain in turn bonded to a nitrogen atom of a polyamine having from 2 to 12 amine nitrogens and from 2 to 40 carbon atoms with a carbon:-nitrogen ratio between 1:1 and 10:1.

9 Claims, No Drawings

LUBRICATING OIL COMPOSITIONS CONTAINING POLYETHER POLYAMINE ETHANES

BACKGROUND OF THE INVENTION

Field of the Invention

This application relates to lubricating oil compositions containing hydrocarbyl poly(oxyalkylene) polyamine ethanes which contribute dispersancy and detergency to the compositions.

Lubricating oil compositions, particularly for use in internal combustion engines, have long performed many functions other than simply lubricating moving parts. Modern-day, highly compounded lubricating oil compositions provide anti-wear, anti-oxidant, extreme-pressure and anti-rust protection in addition to maintaining the cleanliness of the engine by detergency and dispersancy. Many lubricating oil additives are well known for accomplishing these functions. For maintaining engine cleanliness, a well-known class of ashless detergents which have been found to be particularly useful are polyoxyalkylene carbamates. U.S. Pat. Nos. 4,160,648 and 4,247,301 disclose and claim fuel compositions containing certain poly(oxyalkylene) aminocarbamates and polyoxyalkylene polyamines as deposit control additives. While, in general, deposit control additives are not believed to be useful dispersants for lubricating oil compositions, certain aminocarbamates and certain polyamines are useful in this regard.

SUMMARY OF THE INVENTION

It has been found that improved lubricating oil compositions comprise a major amount of an oil of lubricating viscosity and an amount sufficient to provide dispersancy of hydrocarbylpoly(oxyalkylene) polyamine ethanes of molecular weight from about 300 to about 2,500, and preferably from about 800 to about 1,500 and having at least one basic nitrogen atom; wherein said poly(oxyalkylene) moiety is composed of oxyalkylene units selected from 2 to 5 carbon oxyalkylene units and containing at least sufficient branched chain oxyalkylene units to render said carbamate soluble in said lubricating oil composition. The polyoxyalkylene chain is bonded through a terminal oxygen to an ethane or substituted ethane chain or connecting group which is in turn bonded to a nitrogen atom of a polyamine having from about 2 to about 12 amine nitrogens at or about 2 to about 40 carbon atoms with a carbon-nitrogen ratio of between 1:1 and 10:1. The hydrocarbyl-terminating group contains from 1 to 30 carbon atoms and is bonded to the polyoxyalkylene units through an ether oxygen atom.

DETAILED DESCRIPTION OF THE INVENTION

The present invention herein consists of a polyoxyalkylene polyamine ethane, and a lubricating oil composition containing a major amount of oil of lubricating viscosity and from about 0.01 to about 5 weight percent of polyoxyalkylene polyamine ethane as an additive. The polyoxyalkylene polyamine ethane has a molecular weight of from about 300 to about 2500 and preferably from about 800 to about 1500. The additive consists of three parts or moieties. One is the polyamine moiety, the second the poly(oxyalkylene) moiety comprising at least one hydrocarbyl-terminated polyoxyalkylene polymer, bonded through the third moiety, an ethane connecting group or linkage, connected in turn to the nitrogen atom of the polyamine.

As a dispersant, the polyoxyalkylene moiety, the polyamine moiety, and the ethane moiety are selected to provide solubility in the oil composition and dispersant activity without contributing to deposit formation. The additives may be termed hydrocarbyl poly(oxyalkylene) polyamine ethanes or for convenience, "polyether polyamine ethanes". The additives may be prepared from the reaction of a suitable halogenating agent containing the desired ethane moiety, such as ethylene chlorohydrine, with the appropriate substituted epoxide, polymerizing to the polyoxyalkylene chain. This is in turn reacted with the appropriate hydrocarbyl cap which is followed by reaction of the capped polyether chloride with the appropriate polyamine to form the active composition.

Poly(oxyalkylene) Component

The polyoxyalkylene moiety is ordinarily prepared by the reaction of an appropriate chlorohydrine containing the desired ethane connecting group. In the preferred embodiment ethylene chlorohydrine is used, which is reacted under polymerization conditions with the lower alkylene oxides or oxiranes such as propylene oxide or butylene oxide. In the polymerization reaction, a single type of alkylene oxide may be employed. Copolymers, however, are equally satisfactory and random copolymers are readily prepared by contacting the ethylene chlorohydrine compound with a mixture of alkylene oxides. Blocked copolymers of oxyalkylene units also provide satisfactory polyoxyalkylene polymers for the practice of the present invention. Blocked copolymers are prepared by reacting the chlorohydrine with first one alkylene oxide and then the other in any order, or repetitively, under polymerization conditions.

The resulting polyoxyalkylene ethylene chloride is then reacted with the suitable hydrocarbyl cap to complete the precursor of the polyoxyalkylene moiety. The hydrocarbyl cap (R—) contains from 1 to about 30 carbon atoms, preferably from about 2 to about 20 carbon atoms. The hydrocarbyl group may be any straight chain or branched aliphatic, olefinic or alkyl aryl hydrocarbon chain. The hydrocarbyl cap is added to the polyoxyalkylene precursor by the addition of the desired compound group to the polyoxyalkylene ethylene chloride in a catalyzed reaction utilizing an acid ion exchange resin reaction.

The hydrocarbyl polyoxyalkylene ethane moiety consists of one or more, preferably 1 to 2, more preferably one hydrocarbyl-terminated poly(oxyalkylene) polymer, composed of oxyalkylene units containing 2 to about 5 carbon atoms. The poly(oxyalkylene) polymer contains at least one oxyalkylene unit, preferably 1 to 30 units, more preferably 5 to 30 units and most preferably 10 to about 25 oxyalkylene units.

The terminal oxygen atom in the polyoxyalkylene chain is bound to the ethane or substituted ethane connecting group, which is in turn bound to a nitrogen atom of the polyamine.

In general, the poly(oxyalkylene) compounds are mixtures of compounds that differ in polymer chain length. However, their properties closely approximate those of a polymer represented by the average composition and molecular weight.

The ethane connecting group ordinarily consists of a 2-carbon chain ethylene group or an ethylene group with branched units extending from the carbons of the ethylene. The branches of the connecting group consist of low molecular weight alkyl groups of up to 2 carbon atoms. Additionally, in the present invention when the ethylene connecting groups contain branched alkyl groups, the branched groups will not contain the same number of carbon atoms as those extending from the oxyalkylene units of the polyoxyalkylene moiety.

The utilization of compounds containing the ethane or branched ethane connecting groups enhances the composition's use as a dispersant agent by providing the molecule with less steric hindrance and greater polarity at the amine moiety end of the molecule. This allows the molecule to "bind" better to sludge particles and/or deposits thereby enhancing its detergency and dispersancy effect.

Polyamine Component or Moiety

The polyamine moiety of the polyether polyamine is preferably derived from a polyamine having from about 2 to about 12 amine nitrogen atoms and from about 2 to about 10 carbon atoms. The polyamine preferably has a carbon to nitrogen ratio of from about 1:1 to about 10:1. The polyamine will contain at least 1 primary or secondary amine nitrogen atom. The polyamine may be substituted with a substituent group selected from (A) hydrogen; (B) hydrocarbyl groups from about 1 to about 10 carbon atoms; (C) acyl groups from about 2 to about 10 carbon atoms; and (D) monoketo, monohydroxy, monocyano, lower alkyl and lower alkoxy derivatives of (B), (C). "Lower", as used in lower alkyl and lower alkoxy, means a group containing about 1 to 6 carbon atoms. "Hydrocarbyl" denotes an organic radical composed of carbon and hydrogen which may be aliphatic, alicyclic, aromatic or combinations thereof, e.g. aralkyl. Preferably, the hydrocarbyl group will be free of aliphatic unsaturation, i.e., ethylenic and acetylenic, particularly acetylenic unsaturation. The substituted polyamines of the present invention are generally, but not necessarily, N-substituted polyamines. The acyl groups falling within the definition of the aforementioned (C) substituents are such as propionyl, acetyl, etc. The more preferred substituents are hydrogen, $C_1$ to $C_6$ alkyls, and $C_1$–$C_6$ hydroxyalkyls.

The more preferred polyamines finding use within the scope of the present invention are polyalkylene polyamines, including alkylene diamine and including substituted polyamines, e.g. alkyl and hydroxyalkyl substituted polyalkylene polyamines. Preferably the alkylene groups contain from 2 to 6 carbon atoms, there being preferably from 2 to 3 carbon atoms between the nitrogen atoms. Such groups are exemplified by ethyleneamines and include ethylene diamine, diethylene triamine, di(trimethylene) triamine, dipropylenetriamine, triethylenetetramine, etc. Such amines encompass isomers which are the branched-chain polyamines and the previously mentioned substituted polyamines, including hydroxy and hydrocarbyl-substituted polyamines. Among the polyalkylene polyamines, those containing 2 to 12 amine nitrogen atoms and 2 to 24 carbon atoms, are especially preferred and the $C_2$ to $C_3$ alkylene polyamines are most preferred, in particular, the lower polyalkylene polyamines, e.g. ethylene diamine, tetraethylenepentamine, etc.

In many instances a single compound will not be used as reactant in the preparation of the compositions of this invention, in particular the polyamine component. That is, mixtures will be used in which one or two compounds will predominate with the average composition indicated. For example, tetraethylene pentamine prepared by the polymerization of aziridine or the reaction of dichloroethylene and ammonia will have both lower and higher amine numbers, e.g. triethylene tetramine, substituted piperazines and pentaethylene hexamine, but the composition will be mainly tetraethylene pentamine and the empirical formula of the total amine composition will closely approximate that of tetraethylene pentamine.

Compositions

The final compositions comprising the present invention are prepared by the reaction of the hydrocarbyl capped polyoxyalkylene-ethane moiety containing a reactable chlorine or other halogen with the appropriately selected amine or polyamine. The basic substitution reaction yields the attachment of the polyamine to the polyoxyalkylene and the elimination of the hydrogen halide.

The class of preferred polyether polyamine ethanes may be described by the following formula:

$$R\left(OCH_2\underset{\underset{R'}{|}}{CH}\right)_x O\left(CHR^{++}CHR^{+++}\right)N-R''R'''$$

wherein $R = C_1$ to $C_{30}$ aliphatic, olefinic or alkylaryl hydrocarbons;

where $R' =$ hydrogen, $CH_3$—, $C_2H_5$—;

where $R''$ and $R''' =$ hydrogen, $(-CH_2CH_2\overset{H}{N})_xH$ wherein $x = 0$ to 5, $C_1$ to $C_{10}$;

where $R^{++}$ and $R^{+++}$, independently, $=H$, or low molecular alkyl groups up to 5 carbons, and where $R' = R^{++}$ and/or $R^{+++}$; and where $x = 1$ to 30 oxyalkylene units.

The oils which find use in this invention are oils of lubricating viscosity derived from petroleum or synthetic sources. Oils of lubricating viscosity normally have viscosities in the range of 35 to 50,000 Saybolt Universal Seconds (SUS) at 100° F. and more usually from about 50 to 10,000 SUS at 100° F. Examples of such base oils are naphthenic bases, paraffin base and mixed base mineral oils, synthetic oils, for example, alkylene polymers, such as the polymers or propylene, butylene, etc. and mixtures thereof. The amount of additive finding an effective use in the lubricating oil compositions is ordinarily from about 0.01 to about 10 weight percent of the total composition.

Usually included in the oils besides the subject additives are such additives as dispersants/detergents, rust inhibitors, antioxidants, oiliness agents, foam inhibitors, viscosity index improvers, pour point depressants, etc. Usually, these other additives will be present in amounts of from about 0.5 to 15 weight percent of the total composition. Generaly, each of the additives will be present in the range from about 0.01 to 5 weight percent of the total composition.

The following example is presented to illustrate a specific embodiment of the practice of this invention and should not be interpreted as a limitation upon the scope of that invention.

EXAMPLE 1

Preparation of 1-Butyl-capped Polyoxyalkylene-2-N'-Ethylene Diamine Ethane

To an ice-cold solution of 2 mls (3 mmoles) ethylene chlorohydrine in 30 mls of $CH_2Cl_2$ was added 0.5 ml (3.8 mmoles) of boron trifluoride:diethylether (undistilled) in one portion under a nitrogen atmosphere. The cooling bath was removed and butylene oxide added dropwise. The temperature rose rapidly to approximately 40° C. An additional 30 mls (348 mmoles) of butylene oxide was added at such a rate as to maintain an even refluxing, i.e. approximately 2 drops per second. After the addition was complete, the reaction product was allowed to cool to room temperature over a four-hour period and was diluted with additional $CH_2Cl_2$. The solution was extracted with cold water, then with a saturated solution of sodium bicarbonate and then with additional water. The product was stripped without drying and afforded 23.4 grams of a translucent oil after pumping with high vacuum. The product was redried in diethylether over anhydrous magnesium sulfate and was stripped to afford 22.6 grams of polyoxyalkylene ethane chloride.

To a solution of 1.73 grams (2.2 mmoles) of the above chloroethylpolyol and 1.07 grams (5.4 meq) Amberlyst cation ion exchange resin ($H^+$ form) in 5 ml of hexane cooled in dry ice and under a nitrogen atmosphere, was transferred 2.0 ml (2.21 mmoles) of isobutylene. The reaction was warmed to room temperature with stirring.

After 88 hours, the reaction product was diluted with hexane, filtered and stripped to afford 1.7 grams of a clean oil. The crude product was taken up in diethylether and washed three times with water, dried over magnesium sulfate and stripped to afford 1.4 grams of a clean oil.

To an ice-cold solution of 15 ml (224 mmoles) of ethylene diamine was added 1.0 grams of the above product dropwise. The mixture was placed under a nitrogen atmosphere and brought to 80° C. After 23 hours the reaction was cooled, the aliquot removed, diluted with diethylether and washed with distilled water several times, using methanol to keep emulsions down. After neutrality was reached, as indicated by pH paper, using water washings, the ether layer was washed three more times with water, dried over anhydrous potassium carbonate and stripped to afford 0.9 gram of a yellow oil. The basic nitrogen of the resulting product was 2.35%.

All specific embodiments of the invention have been described in detail. It should be understood that the invention is to be given the broadest possible interpretation within the terms of the following claims.

What is claimed is:

1. A lubricating oil composition comprising a major portion of oil of lubricating viscosity, and a minor amount of hydrocarbyl polyoxyalkylene polyamine ethane of molecular weight from about 300 to about 2500; wherein said hydrocarbyl group contains from 1 to about 30 carbon atoms, said polyoxyalkylene moiety comprises 1 to 30 oxyalkylene units selected from oxyalkylene units having from 2 to about 5 carbon atoms, said ethane moiety contains from about 2 to about 8 carbon atoms and said polyamine moiety comprises from about 2 to about 12 amine nitrogen atoms and from about 2 to 40 carbon atoms.

2. A lubricating oil composition according to claim 1 in which said oxyalkylene units are selected from oxyalkylene units having from 3 to 4 carbon atoms.

3. A lubricating oil composition according to claim 1 in which said hydrocarbyl polyoxyalkylene polyamine ethane has a molecular weight of about 800 to about 1500.

4. A lubricating oil composition according to claim 1 in which said hydrocarbyl group contains from 2 to 20 carbon atoms.

5. A lubricating oil composition according to claim 1 in which said ethane moiety contains 2 to 4 carbon atoms.

6. A lubricating oil composition according to claim 1 in which units substituted on the ethane moiety do not contain the same number of carbons as the branches of the oxyalkylene units of the same molecule.

7. A lubricating oil composition according to claim 1 in which said polyamine moiety is derived from lower polyalkylene polyamines and contains at least one primary or secondary amine nitrogen atom.

8. A lubricating oil composition according to claim 7 in which said lower polyalkylene polyamine is ethylene diamine or diethylene triamine.

9. A lubricating oil according to claim 1, 2, 3, 4, 5, 6, 7, or 8 in which said minor amount of said hydrocarbyl polyoxyalkylene polyamine ethane comprises about 0.01 to about 10 weight percent of the total composition.

* * * * *